US005108139A

United States Patent [19]

Leech

[11] Patent Number: 5,108,139

[45] Date of Patent: Apr. 28, 1992

[54] DEVICE FOR REMOTELY ACTUATING THE SAFETY LATCH OF A HOIST HOOK

[76] Inventor: Kenneth E. Leech, Box 800 Rte. 2, Summerton, S.C. 29148

[21] Appl. No.: 637,287

[22] Filed: Jan. 3, 1991

[51] Int. Cl.[5] ..... B66C 1/36

[52] U.S. Cl. ..... 294/82.17; 294/82.19

[58] Field of Search ..... 294/82.1, 82.11, 82.17, 294/82.19, 82.2, 82.21, 82.22, 82.23, 82.24, 82.31, 82.34, 82.35

[56] References Cited

U.S. PATENT DOCUMENTS

| | | | |
|---|---|---|---|
| 555,462 | 2/1896 | Morrow | 294/82.33 |
| 653,021 | 7/1900 | Hamilton | 294/82.19 X |
| 2,603,524 | 7/1952 | Amelung | 294/82.35 |
| 3,895,836 | 7/1975 | Barnes | 294/82.35 |
| 4,193,627 | 3/1980 | Cranston et al. | 294/82.19 |
| 4,195,872 | 4/1980 | Skaalen et al. | 294/82.19 |
| 4,751,892 | 6/1988 | Sechel et al. | 294/82.19 X |

FOREIGN PATENT DOCUMENTS

| | | | |
|---|---|---|---|
| 59329 | 5/1938 | Norway | 294/82.33 |
| 703469 | 12/1979 | U.S.S.R. | 294/82.35 |

*Primary Examiner*—Margaret A. Focarino
*Assistant Examiner*—Dean J. Kramer

[57] ABSTRACT

A device for remotely actuating the safety latch of a lift hook associated with a hoist arrangement is disclosed including a bracket adapted to attach to the hook attachment member of the hoist arrangement and extending laterally from the hook and hook attachement member and carrying a pulley which supports a cable adapted to attach to the safety latch associated with the hook. The cable attaches to a rope which depends to a remote location for actuation by a user.

5 Claims, 2 Drawing Sheets

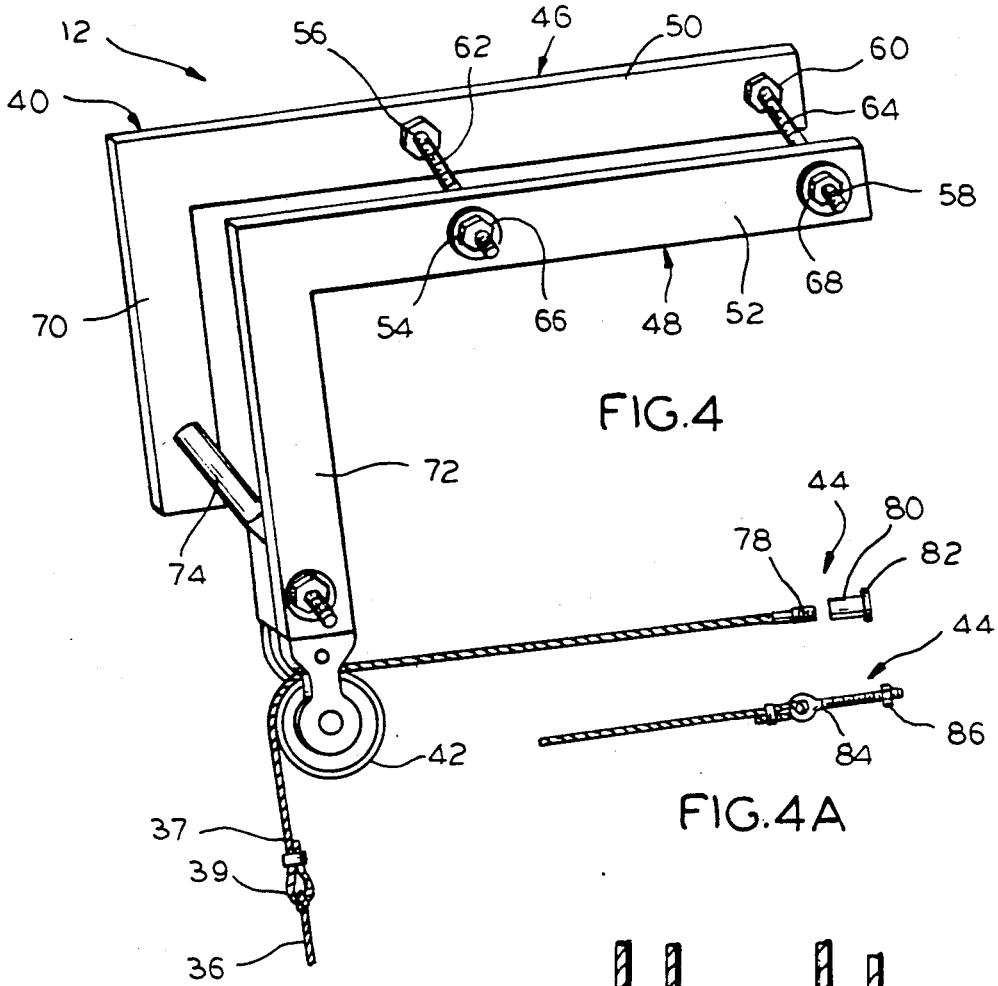
FIG.4
FIG.4A
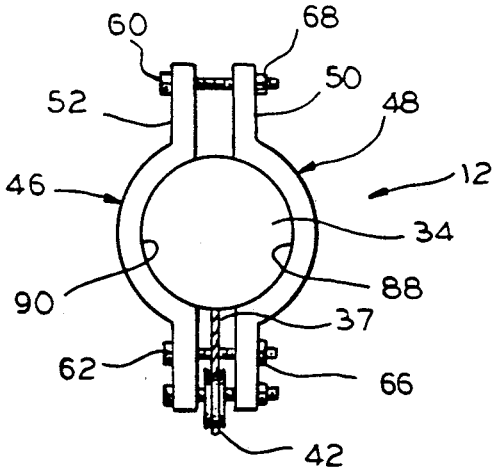
FIG.6
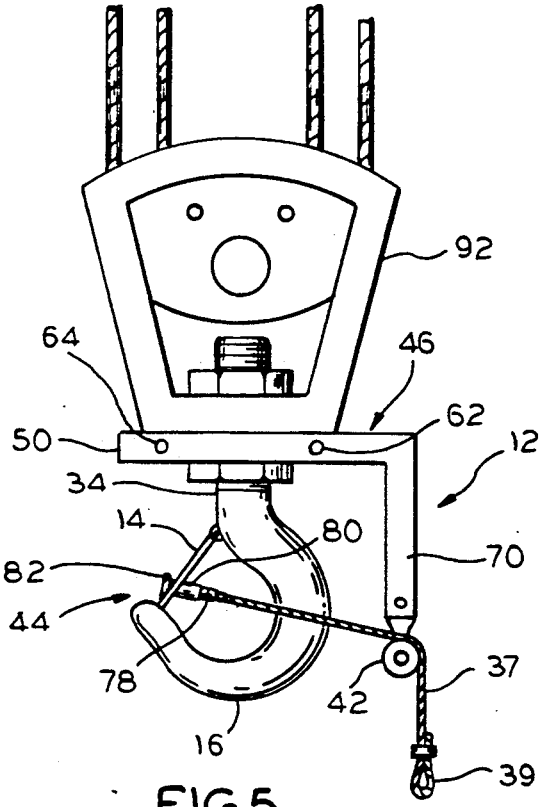
FIG.5

DEVICE FOR REMOTELY ACTUATING THE SAFETY LATCH OF A HOIST HOOK

BACKGROUND OF THE INVENTION

This invention relates to safety devices. More particularly, the invention relates to a device for remotely actuating a safety latch associated with a hoist hook.

Hooks provided on the lower pulley or hook attachment member of a hoist typically include a pivotable safety latch which closes the hook opening to prevent the rigging or load which is supported by the hook from accidentally coming off the hook. In very large crane applications such as in building construction where large loads such as steel columns are supported by rigging held by the hook supported from the end of the crane's cable and a pulley arrangement, it is not uncommon for workers to tie the safety latch of the hook back so that the hook remains open. This is typically done because, once the load has been placed in position, the hook end of the crane's cable and the safety latch is not always readily accessible so as to allow easy manual opening of the latch to release the rigging. Further, when heavy loads such as steel columns are being positioned during building erection, it is not uncommon for the rigging on the hook to jump loose from the hook when the column is set in place if the safety latch has been tied back. This unsafe practice of tieing back the safety latch on the lift hook is known in the trade as "mousing the latch" and is a very unsafe practice.

SUMMARY OF THE INVENTION

Accordingly, it is the object of the present invention to provide for a device which will actuate the safety latch of a lift hook from a remote location so that the operator will be deterred from "mousing the latch".

According to the invention, there is provided bracket means adapted to attach to the hook means including a hook and a hook attachment member of a hoist arrangement which bracket carries a pulley supporting rope means having means at one end for attachment to the safety latch of the hook. The rope means depends from the bracket and is actuated by the operator to cause the safety latch to open.

According to one embodiment of the invention, the bracket is a pair of parallel spaced apart members including means for being clamped to the hook attachment member with the spaced apart members extending laterally from the attachment member and having the pulley mounted between the members at a laterally displaced end of the members.

According to another embodiment of the invention, the parallel spaced apart bracket members include facing concave portions proximate one end for engagement to opposite sides of complimentary shaped surfaces of the hook means associated with the hoist arrangement and a pair of fasteners for drawing the members together against the hook means.

According to a preferred embodiment of the invention, the bracket is an L-shaped member adapted at one end of a laterally orientated leg portion to attach to the hook attachment member and having the pulley mounted at the end of a depending leg portion of the bracket member.

According to an important feature of the invention, the rope means is a metallic cable supported by the pulley having one end attached to the safety latch of the hook and an opposite end adapted to attach to a non-metallic rope which depends to an operator for actuation.

According to another feature of the invention, the cable is attached to the safety latch by way of a flanged female threaded part associated with the safety latch and a male threaded part attached to the cable and threaded into the female part.

BRIEF DESCRIPTION OF THE DRAWINGS

The invention will be better understood after reading the following Detailed Description of the Preferred Embodiment in conjunction with the drawings of which:

FIG. 4 is a perspective view of a preferred embodiment of the invention showing details of construction;

FIG. 4A is a view of a portion of the safety latch actuating rope showing an alternate attachment member for attaching the actuating rope to the safety latch of the lift hook;

FIG. 5 is a side view of a lower pulley block of a block and tackle-type hoist arrangement showing another embodiment of the invention and details of the preferred latch attachment member; and FIG. 6 is a top view of the safety latch operating device of FIG. 5 showing further details of construction.

DETAILED DESCRIPTION OF THE PREFERRED EMBODIMENT

Figure 3:
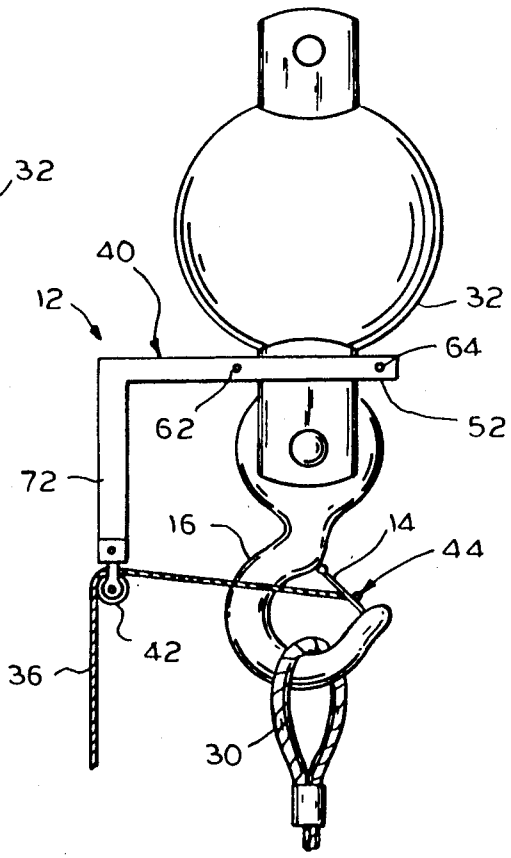
FIG. 3 is a front view of the hook and headace of FIG. 1 showing the safety latch remote actuating device according to the invention attached to the headace.
Figure 2:
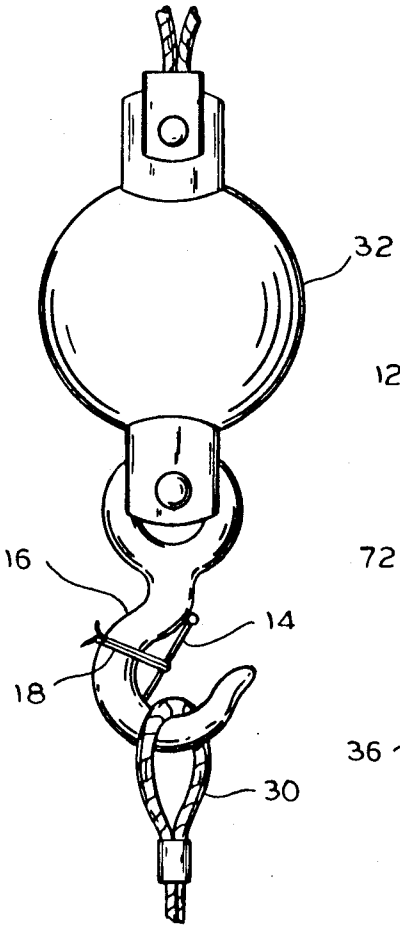
FIG. 2 is a front view of a common lift hook and common headace-type hook attachment member portion of a hoist arrangement showing a portion of a load rigging supported by a hook and the undesirable practice of tieing the safety latch associated with the hook back so as to keep the hook open.
Figure 1:
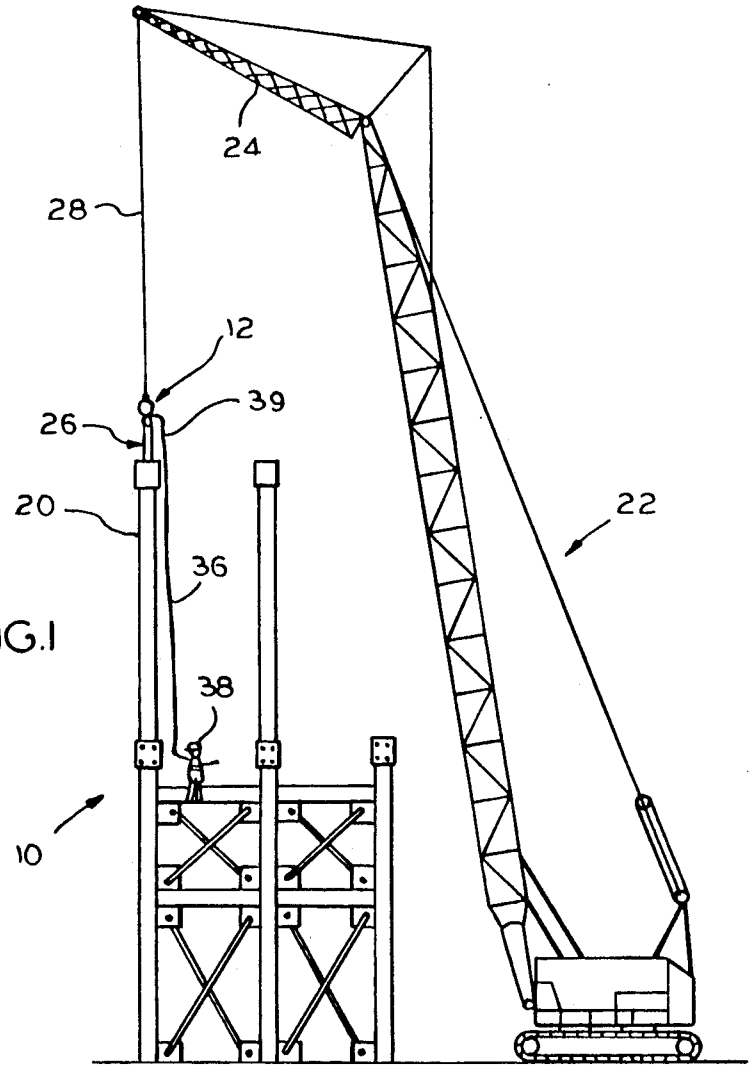
FIG. 1 is a schematic view of a construction site showing the invention in use.

FIG. 1 shows a typical construction 10 wherein the safety latch remote actuating device 12 according to the invention is applicable and FIG. 2 shows the practice known in the trade as "mousing the latch" wherein the safety latch 14 of the lift hook 16 is tied back, for example with a rope or wire 18, so that the hook remains open. As shown in FIGS. 1 and 2 and described in the background section above, when an element such as a steel column 20 is lowered by a crane 22 for setting in place on the structure being erected, it is invariably not possible for the crane operator to set these large heavy elements in place without some bumping of the end of the column on the structure. Downward inertia of the crane boom 24, hoist arrangement 26 and cable 28 can cause the load rigging 30 to jump off of the open hook 16 when the column abruptly stops against the structure if the safety latch is tied back. The present invention includes a device 12 which attaches to common lift hooks or lift hook attachment members of hoist arrangements, such as a headace 32 shown in FIG. 3 or shank 34 of a lift hook 16 shown in FIG. 5. An actuating rope 36, which according to the broadest embodiment as shown in FIG. 3 is a single, lightweight, non-metallic, such as fiber, rope, depends down to a worker 38 for actuation. As described below, the actuating rope 36 attaches to the safety latch 14 of the hook 16 to be opened when the worker pulls down on the actuating rope. It is to be understood that throughout this disclosure the term rope and rope means, unless otherwise stated, is intended to be generic and to include all forms of rope including both fiber and metallic rope, wires and cables and that the cable is intended to mean nonfiber, metallic rope including but not limited to stranded or solid wire or cable.

Referring to FIGS. 3 and 4, the device 12 includes a bracket 40 which is adapted proximate one end for attachment to the hook attachment member 32 and which extends laterally from the hook attachment member when so attached. An end of the bracket which is laterally displaced from the hook attachment member carries a pulley 42 on which is supported the actuating rope 36. One end of the actuating rope is provided with a latch attachment member 44 discribed hereinbelow for attachment to the safety latch 14 as noted.

In the embodiments of FIGS. 3 and 4, the bracket 40 includes a pair of parallel spaced apart members shown generally as members 46, 48. The bracket can take many shapes including straight members or the preferred L-shaped configuration shown in FIGS. 3 and 4 wherein upper leg portions 50, 52 are provided with two pair of aligned holes 54, 56 and 58, 60 having bolts 62, 64 and nuts 66, 68 for drawing the members together to be clamped to the hook attachment member such as the headace 32. Lower leg portions 70, 72 are held spaced apart by a spacer 74 and the pulley 42 is secured at the lower end of the lower leg portions, for example, near to leg portion 72, so as to provide access to the safety latch with minimum interference between the actuating rope and the side of the hook 16. Preferably, the lower leg portions 70, 72 are of a length so as to position the pulley generally horizontally opposite the safety latch of the hook.

As noted above, the actuating rope 36 can be a one piece continuous member attached directly to the safety latch and having a length to reach the user however, the preferred actuating rope is a length of metallic cable 37 supported by the pulley 42 having one end attached to the safety latch by way of the attachment member 44 and having an opposite end, end 39 in FIG. 4, depending a short distance below the pulley and adapted to have a lightweight, non-metallic rope 36 attached thereto. In the situation where a single length of actuating rope 36 is used, as shown in FIG. 3, the rope must be light-in-weight and preferably fiber to prevent the weight of the rope from opening the safety latch. However, because there can be some rubbing between the actuating rope and side of the hook 16, which can, over time, excessively wear a fiber rope presenting the possibility that the rope will break, it is preferred that the short length of metallic cable 37 to which the light weight fiber rope is attached, as shown in FIG. 4, be used. Advantageously, the metallic cable 37 eliminates wear at the hook resulting in longer and safer operation. As shown in the drawings, since the major portion of the metallic cable 37 lies generally horizontally between the latch and pulley, eventhough the metallic cable is heavier than a fiber rope, only minimum opening force is exerted on the latch by the weight of the cable and provided that a lighter weight rope, such as a fiber rope, is used to reach the user, the latch will not prematurely open but will remain closed until the user pulls on the actuating rope.

As seen best in FIGS. 4 and 5, the cable to latch attachment member 44 is a two piece bullet type member including a male threaded member 78 attached to the cable 37, for example by crimping the member to the cable end, and a female threaded member 80 into which the male threaded member is threaded after inserting the female member through a hole provided in the latch. A flange 82 on the female member engages against the latch, as shown in FIG. 5, to pull the latch open.

An alternative attachment member is shown in FIG. 4A and includes an eyebolt 84 inserted through a hole in the safety latch which is secured by a nut 86. The actuating rope 37 is secured to the eye of the eyebolt.

The embodiment of the unlatching device shown in FIGS. 5 and 6 is generally the same as that according to FIGS. 3 and 4 except that the upper legs 50, 52 of the bracket members 46, 48 are provided with facing concave portions 88, 90 conforming to the external surface shape of the shank 34 of the hook 16 which, in the multiple pulley hoist arrangement shown in FIG. 5, is structured to swivel in the lower pulley block 92 of the hoist. The bracket members 46, 48 are retained to the shank of the hook by clamping the members as in the embodiment of FIGS. 3 and 4. Accordingly, the latch actuating device is able to swivel with the hook. The pulley 42 is mounted at the lower free end of the depending leg portions of the bracket with the metalic cable 37 supported by the pulley and attached at one end to the safety latch 14 and adapted to have a user supplied non-metallic rope attached at its free end as described above.

Having described the preferred embodiment of the invention, those skilled in the art having the benefit of the description and the accompanying drawings can readily devise other embodiments and modifications which are to be considered to be within the scope the appended claims.

What is claimed is:

1. A device for remotely opening a safety latch on a hook of a hoist comprising:

bracket means including a pair of parallel spaced apart members including facing concave portions conforming to complimentary shaped surfaces of hook means associated with said hoist arrangement, said hook means including at least a hook attachment member;

fastener means for drawing said spaced apart members together to clamp said spaced apart members to said hook means with said spaced apart members extending laterally from said hook and hook attachment member;

a pulley mounted to at least one of said spaced apart members at a location laterally from said hook; and rope means supported by said pully including means at one end adapted to attach to the safety latch on the hook, whereby when said rope is pulled said safety latch is moved from a closed position to an open position.

2. A device for remotely opening a safety latch provided on a hook of a hoist of the type including a pulley block to which the hook is swivelly attached comprising:

bracket means adapted to attach to said hook;

pulley means mounted to said bracket means;

rope means supported by said pulley means including means at one end of said rope means for attaching said rope means to said safety latch on the hook, a male threaded member at said one end of said rope means and a female threaded member associated with said safety latch, said male threaded member threadedly received in said female threaded member.

3. The device as defined in claim 2 wherein said rope means includes a metallic cable.

4. The device as defined in claim 3 wherein an end of said cable opposite said one end includes means for attachment to a nonmetallic rope.

5. A device for remotely opening a safety latch on a hook of a hoist arrangement comprising:

a pair of parallel spaced apart L-shaped memners, each of said L-shaped members adapted at one end to be clamped to a hook attachment member of said hoist arrangement with said pair of L-shaped members extending laterally from said hook and said hook attachment member;

a pulley mounted to at least one of said L-shaped members proximate an end opposite to said one end so that said pulley is laterally disposed from said hook when said pair of L-shaped members are clamped to said hook attachment member; and rope means supported by said pulley including means at one end of said rope means adapted to attach to the safety latch on the hook whereby, when said rope means is pulled said safety latch is moved from a closed position to an open position.

* * * * *